US006173841B1

(12) United States Patent
Yanagimoto et al.

(10) Patent No.: US 6,173,841 B1
(45) Date of Patent: Jan. 16, 2001

(54) FILM CARTRIDGE SORTING DEVICE FOR USE WITH PHOTOGRAPHIC FILM PROCESSOR

(75) Inventors: Takekazu Yanagimoto; Shu Nakajima, both of Kanagawa (JP)

(73) Assignee: Fuji Photo Film Co., Ltd., Kanagawa (JP)

( * ) Notice: Under 35 U.S.C. 154(b), the term of this patent shall be extended for 0 days.

(21) Appl. No.: 09/192,262

(22) Filed: Nov. 16, 1998

(30) Foreign Application Priority Data

Nov. 18, 1997 (JP) ..... 9-317481

(51) Int. Cl.[7] ..... B07B 13/05

(52) U.S. Cl. ..... 209/682; 209/680; 209/675; 209/707; 209/911; 209/924; 209/920; 209/311; 209/315; 209/317

(58) Field of Search ..... 209/680, 682, 209/675, 707, 911, 924, 920, 311, 315, 317, 80

(56) References Cited

U.S. PATENT DOCUMENTS

| | | | | |
|---|---|---|---|---|
| 2,192,076 | * | 2/1940 | Grow | 209/315 |
| 3,347,368 | * | 10/1967 | Mogensen | 209/99 |
| 3,799,336 | * | 3/1974 | Holman | 209/85 |
| 3,956,109 | * | 5/1976 | Dietsche | 209/73 |
| 4,143,769 | * | 3/1979 | Ripple | 209/544 |
| 4,371,435 | * | 2/1983 | Eckersley | 209/44 |
| 4,519,507 | * | 5/1985 | Gillette et al. | 209/682 |
| 4,688,679 | * | 8/1987 | Lindgren | 209/691 |
| 4,802,591 | * | 2/1989 | Lower et al. | 209/680 |
| 5,116,486 | * | 5/1992 | Pederson | 209/12 |
| 5,248,046 | * | 9/1993 | Rollason | 209/675 |
| 5,941,395 | * | 8/1999 | Aho et al. | 209/314 |

FOREIGN PATENT DOCUMENTS

| | | | | |
|---|---|---|---|---|
| 0239957 | * | 10/1986 | (DE) | 209/682 |
| 1268554 | * | 3/1972 | (GB) | 209/682 |

* cited by examiner

*Primary Examiner*—Donald P. Walsh
*Assistant Examiner*—David Jones
(74) *Attorney, Agent, or Firm*—Sughrue, Mion, Zinn, Macpeak & Seas, PLLC

(57) ABSTRACT

In a film processor, filmstrips are contained in their specific cartridge shells with their film leaders attached to a leader plate, and are fed into processing baths with the leader plate in the lead, while being pulled out from the cartridge shells. After the filmstrips are separated from the cartridge shells, the cartridge shells drop on a chute and slide down on the chute. Smaller cartridge shells sift through a sifting slit formed through the chute along the sliding direction, while larger cartridge shells slide down to a lower end of the chute. A lateral guide plate extends under the sifting slit, to guide smaller cartridge shells having sifted through the sifting slit in the lateral direction of the sifting chute toward a cartridge recovery box. Larger cartridge shells drop from the lower end of the chute down to a second cartridge recovery box.

15 Claims, 10 Drawing Sheets

FILM CARTRIDGE SORTING DEVICE FOR USE WITH PHOTOGRAPHIC FILM PROCESSOR

BACKGROUND OF THE INVENTION

1. Field of the Invention

The present invention relates to a film cartridge sorting device for sorting film cartridges, especially those film cartridges which are to be discharged from a photographic film processor. The present invention also relates to a photographic film processor having the film cartridge sorting device incorporated thereinto.

2. Background Arts

There are various types of photo film cartridges, including ISO135 type, ISO110 type, ISO120 type and IX240 type. Cartridge shells as well as photo filmstrips are different in size and format between these types.

For development in a small scale automatic photographic film processor, hereinafter referred to as a mini-lab film processor, a film leader of a photo filmstrip is secured to a leader plate. Thereafter, the filmstrip is guided with the leader plate in the lead through several processing baths, such as a color developing bath, a bleaching bath, a bleach-fix bath, a super rinsing bath, and a stabilizing bath, as well as a drier section.

As for the ISO135 type photo film cartridge, the film leader is pulled out from its cartridge shell, and is attached to the leader plate. Thereafter, the cartridge shell is placed on a cartridge holder of the mini-lab film processor, while the filmstrip with its leader attached to the leader plate is further pulled out from the cartridge shell and is fed into the processing baths. When the filmstrip is fully pulled out from the cartridge shell, the filmstrip is cut at the trailing end off the cartridge shell. Then, the empty cartridge shell is dropped from the cartridge holder down to a cartridge recovery box.

As for other types of photo film cartridges, on the other hand, the individual photo filmstrip is pulled out from its original cartridge shell and then rewound into an intermediate cartridge shell that is specific to each film type. That is, the intermediate cartridge shells have different sizes from that of the ISO135 type cartridge shell, as well as from each other according to the film type. After the filmstrip is rewound into the intermediate cartridge shell, an end of the filmstrip that remains outside the shell is attached to the leader plate, and is placed in the mini-lab film processor in the same way as the ISO135 type photo film cartridge. An inner end of the filmstrip is not securely fastened in the intermediate cartridge shell, so that the filmstrip finally slips off the intermediate cartridge shell as the filmstrip is fed into the processing baths. When the entire length of the filmstrip is fed out of the intermediate cartridge shell, the intermediate cartridge shell drops off the cartridge holder down to the same cartridge recovery box as used for receiving the cartridge shell of the ISO135 type.

Among from the cartridge shells collected in the cartridge recovery box, the ISO 135 type cartridge shells are sorted out as wastes. The intermediate cartridge shells are also sorted according the film type, and are reused over again for containing filmstrips to develop.

Conventionally, sorting of the cartridge shells collected in the cartridge recovery box has been made by hand. This is labor intensive and inefficient.

An object of the present invention is to provide a film cartridge sorting device that can automatically sort the film cartridges according to the size of their cartridge shells.

Another object of the present invention is to provide a film cartridge sorting device that is simple in construction, and works without the need for electricity, and thus save the electric power.

SUMMARY OF THE INVENTION

The present invention is comprised of a chute to which the film cartridges to sort are fed; and a sifting slit formed through a bottom side of said chute along the sliding direction of the film cartridges, said sifting slit letting smaller film cartridges than a predetermined size fall therethrough, while larger film cartridges than the predetermined size slide down to a lower end of said chute.

According to a preferred embodiment, the chute is constituted of a pair of guide plates elongated in the sliding direction, said guide plates forming a substantially V-shaped sliding surface, and said guide plates being spaced laterally from each other to form said sifting slit.

According to another preferred embodiment, the cartridge sorting device further comprising a lateral guide plate extending under said sifting slit, for guiding said smaller cartridge shells having sifted through said sifting slit in the lateral direction of said sifting chute. This configuration facilitates arranging a plurality of said chutes vertically from one another, such that the lower end of an upper one of said chutes is opposed to an upper end of a next one of said chutes to provide a zigzag sliding path.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein.

DETAILED DESCRIPTION OF THE PREFERRED EMBODIMENT

Figure 1:
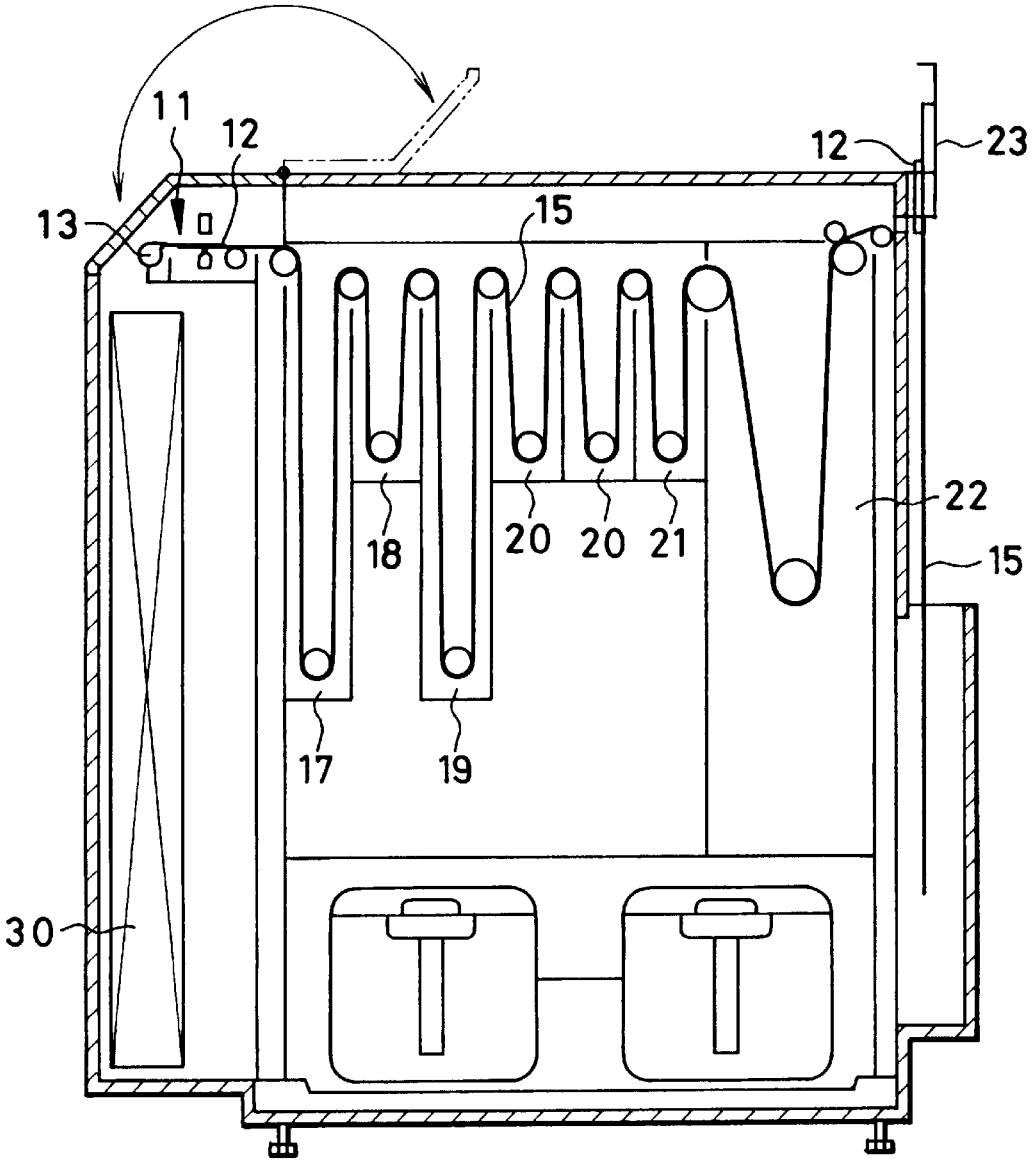
FIG. 1 is an explanatory sectional view of a mini-lab film processor having a film cartridge sorting device incorporated thereinto.
Figure 2A:
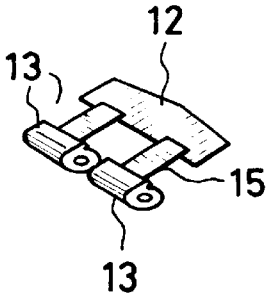
FIG. 2A is a perspective view of ISO135 type photo film cartridges with their film leaders attached to a leader plate.
Figure 2B:
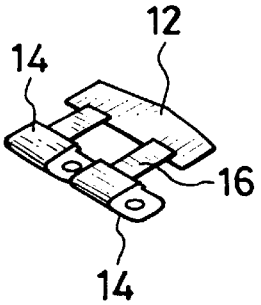
FIG. 2B is a perspective view of filmstrips contained in intermediate cartridge shells with their film leaders attached to a leader plate.

In a mini-lab film processor shown in FIG. 1, a film entry section 11 can hold more than one cartridge containing a filmstrip to develop. As for the ISO135 type photo film cartridges, filmstrips 15 are pulled out from their cartridge shells 13 and are attached to a leader plate 12, as shown in FIG. 2A. As for other types of photo film cartridges, e.g. IX240 type photo film cartridges, the filmstrips 16 are rewound into intermediate cartridge shells 14. Thereafter, a film leader of the filmstrip 16 in the intermediate cartridge shell 14 is attached to the leader plate 12, as shown in FIG. 2B.

Then, the cartridge shells 13 or 14 are placed with the filmstrips 15 or 16 and the leader plate 12 in the film entry section 11. The filmstrips 15 or 16 are further pulled out from the cartridge shells 13 or 14 to be fed into processing baths, including a color developing bath 17, a bleaching bath 18, a bleach-fix bath 19, a super rinsing bath 20, and a stabilizing bath 21. Thereafter the filmstrips 15 or 16 are fed into a drier section 22. The filmstrips 15 or 16 developed in this way are hung on a film hanger 23 with their leader plate 12 upside, and stored for a while in the mini-lab film processor. Thereafter, photo prints are made from the developed filmstrips 15 or 16. After the printing, the filmstrip 15 of the ISO135 type is cut into shorter lengths and inserted into a film sheath. The film sheath containing the developed filmstrip is returned to the individual customer, mostly along with the subsequent photo prints. The filmstrip 16 of the IX240 type is wound back, after the printing, into the original cartridge shell, and is returned to the individual customer.

The empty cartridge shells 13 or 14 are dropped into a film cartridge sorting device 30 that is provided in the mini-lab film processor.

Figure 3:
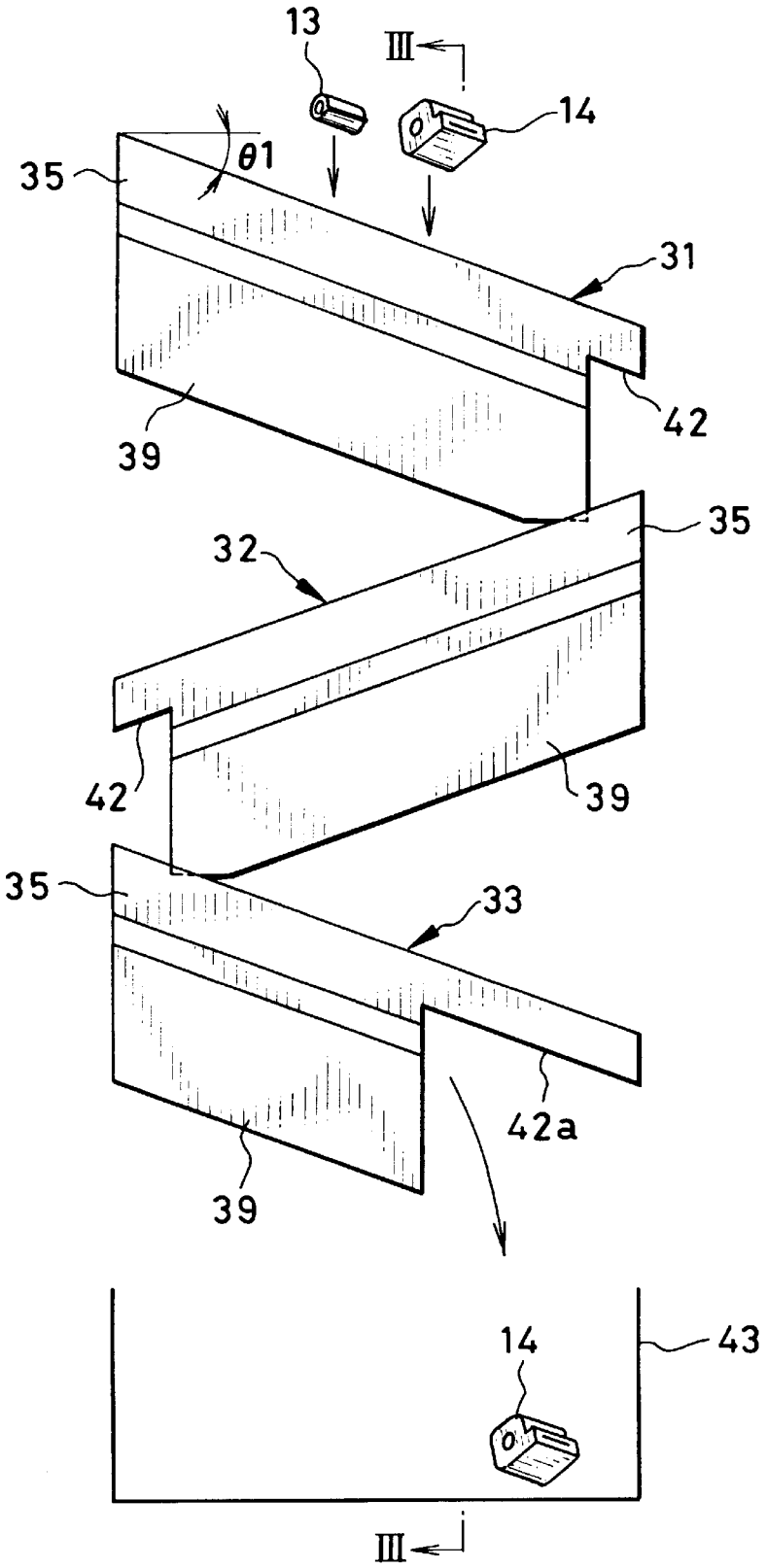
FIG. 3 is an explanatory side view of a film cartridge sorting device according to a first embodiment of the present invention.

According to the first embodiment shown in FIG. 3, the film cartridge sorting device 30 is constituted of three sifting chutes 31, 32 and 33 which are arranged vertically from one another in this order from the top. The sifting chutes 31 to 33 are alternately inclined in the opposite directions, so the sliding directions on the sifting chutes 31 to 33 change alternately, providing a zigzag sliding path as a whole. In this embodiment, each of the sifting chutes 31 to 33 has a length of 300 mm, whereas the mini-lab processor has a width of about 400 mm, so the sifting chutes 31 to 33 can extend across the width of the mini-lab processor. The three sifting chutes 31 to 33 have the same inclination angle Θ1, e.g. 20 degrees, with respect to the horizontal. However, the length and the inclination angle of the sifting chutes 31 to 33 may be changed according to the conditions of the sifting chutes 31 to 33, e.g. the frictional factor of their surfaces.

Figure 4:
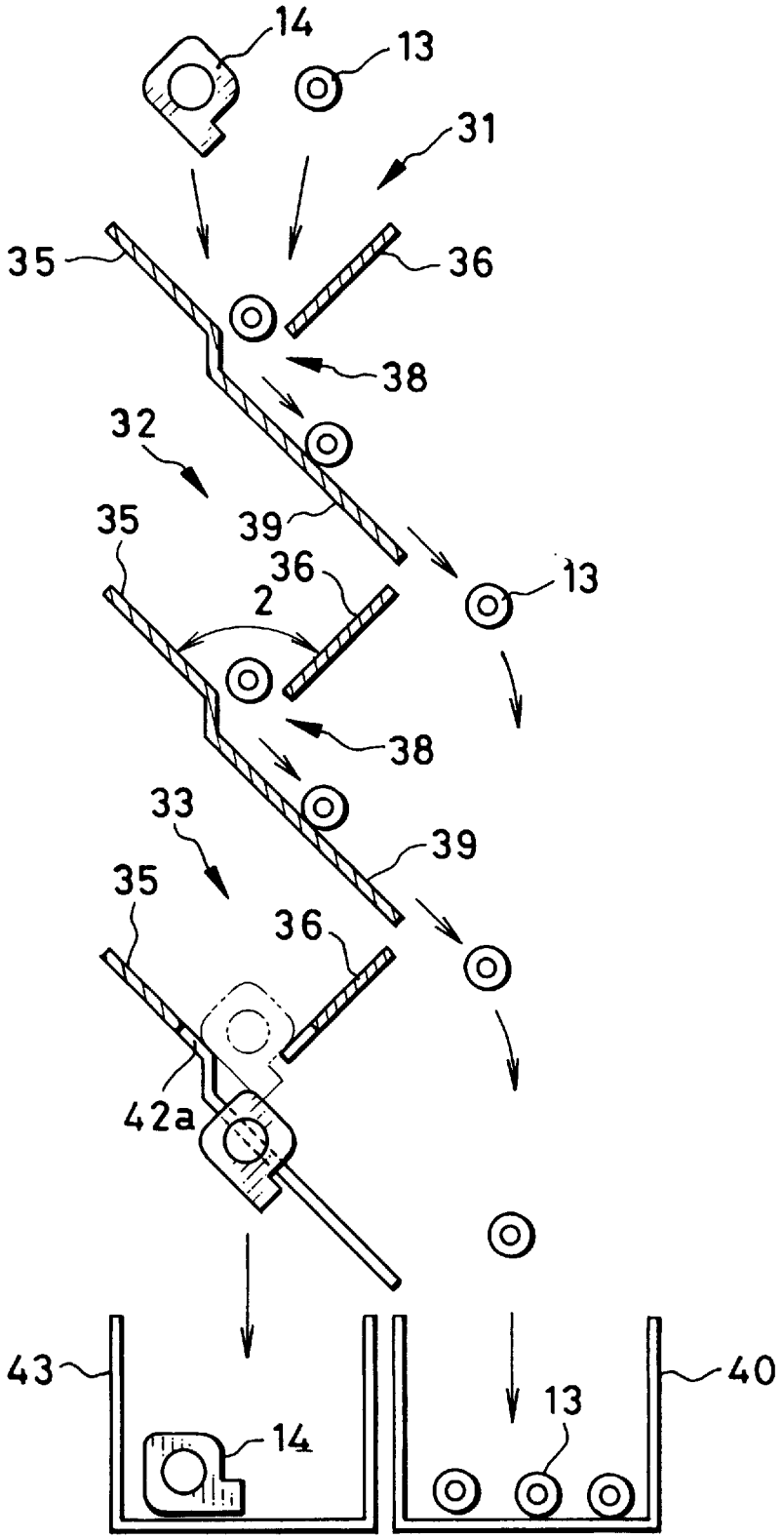
FIG. 4 is a sectional view of the film cartridge sorting device, taken along a line III—III of FIG. 3.

As shown in FIG. 4, each of the sifting chutes 31 to 33 is constituted of a pair of guide plates 35 and 36 which are inclined in the opposite directions with respect to the vertical, so the guide plates 35 and 36 form a substantially V-shaped sliding surface. In this embodiment, the guide plates 35 and 36 meet at an angle Θ2 of 90°, but the angle Θ2 can be other than 90°. A sifting slit 38 is formed along the bottom of each of the sifting chutes 31 to 33 between the guide plates 35 and 36. The sifting slits 38 have a width that allows only the ISO135 type cartridge shell 13 to sift therethrough, and does not let the intermediate cartridge shell 14 and other types of cartridge shells therethrough. In this embodiment, the width of the sifting slit 38 is 27.5 mm, since the diameter of the ISO135 type cartridge shell 13 is about 25 mm.

Figure 5:
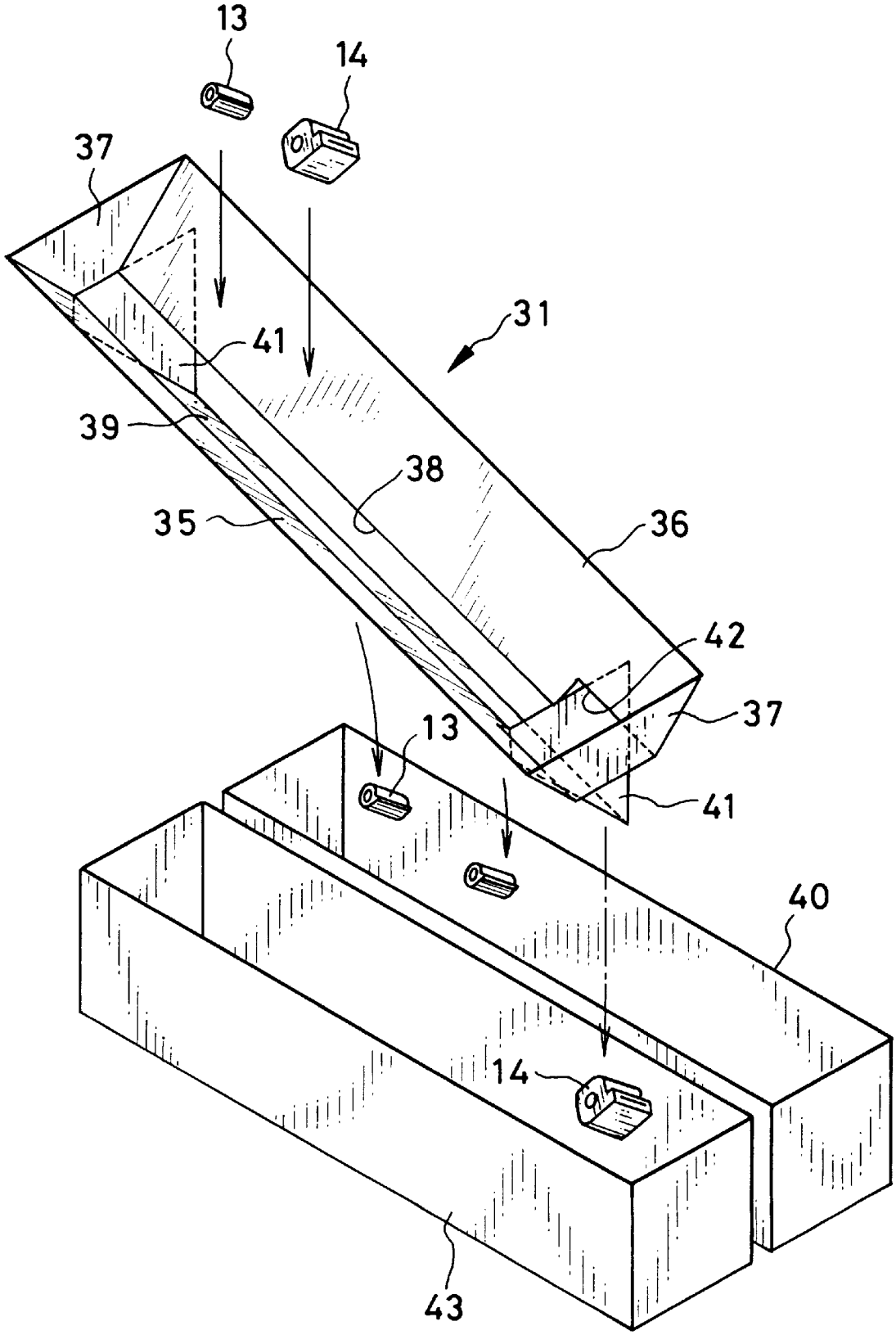
FIG. 5 is an explanatory perspective view of the film cartridge sorting device of FIG. 3.

Accordingly, when a mixture of the ISO135 type cartridge shells 13 and the intermediate cartridge shells 14 drop from the film entry section 11 onto an upper portion of the sifting chute 31, the ISO135 type cartridge shells 13 sift through the sifting slits 38 while sliding down the sifting chutes 31 to 33, whereas the intermediate cartridge shells 14 slide down to the lower end of the lowest sifting chute 33. As shown in FIG. 5, stop plates 37 are provided at the upper and lower ends of the sifting chutes 31 to 33 to prevent the cartridge shells 13 and 14 from falling off the sifting chutes 31 to 33 at these ends. It is to be noted that the lower sifting chutes 32 and 33 are not illustrated in FIG. 5 for clarity sake.

To guide the ISO135 type cartridge shells 13 to one lateral sides of the sifting chutes 31 to 33, a lateral guide plate 39 is provided under each sifting slit 38. In this embodiment, the lateral guide plate 39 is formed integrally with the guide plates 35. The ISO135 type cartridge shells 13 passing through the sifting slits 38 slide down the lateral guide plates 39 and drop down into a cartridge recovery box 40 for the ISO135 type cartridge shells 14. As shown in FIG. 5, stop plates 41 are provided at longitudinal ends of the lateral guide plates 39, for preventing the ISO135 type cartridge shells 13 from falling off the lateral guide plate 39 down to the lower sifting chute 32 or 33.

The sifting chutes 31 to 33 further have dropping openings 42 and 42*a* for the intermediate cartridge shells 14 at their lower ends in connection to the sifting slits 38. The dropping openings 42 and 42*a* are wider than the sifting slits 38, e.g. 40 mm wide, so the intermediate cartridge shells 14 can get through the dropping openings 42 and 42*a* and drop down to the lower sifting chute 32 or 33, or to a second cartridge recovery box 43 that is provided for the intermediate cartridge shells 14. In this embodiment the dropping openings 42 and 42*a* of the upper two sifting chutes 31 and 32 have a length of 70 mm, whereas the dropping opening 42*a* of the lowest sifting chute 33 has a length of about 140 mm. That is, the sifting slit 38 of the lowest chute 33 is shorter than those of the upper chute 31 and 32 because most of the ISO135 type cartridge shells 13 sift through the sifting slits 38 of the upper sifting chutes 31 and 32.

The cartridge recovery boxes 40 and 43 are drawn out from the mini-lab film processor through a door that is not illustrated in the drawings. In this way, the ISO135 type cartridge shells 13 are automatically sorted out from the intermediate cartridge shells 14. The ISO135 type cartridge shells 13 may be damaged by the shock that is given when they fall from the upper sifting chutes 31 and 32 down to the cartridge recovery box 40. But it does not matter to the ISO135 type cartridge shells 13, because the ISO135 type cartridge shells 13 are thrown away as industrial waste, or broken for recovering materials. On the contrary, since the intermediate cartridge shells 14 are discharged through the dropping opening 42*a* of the lowest sifting chute 33, the shock given to the intermediate cartridge shells 14 is minimum. Therefore, the cartridge sorting device 30 of the present invention is preferable for the sake of reusing the intermediate cartridge shells 14 many times.

Figure 6:
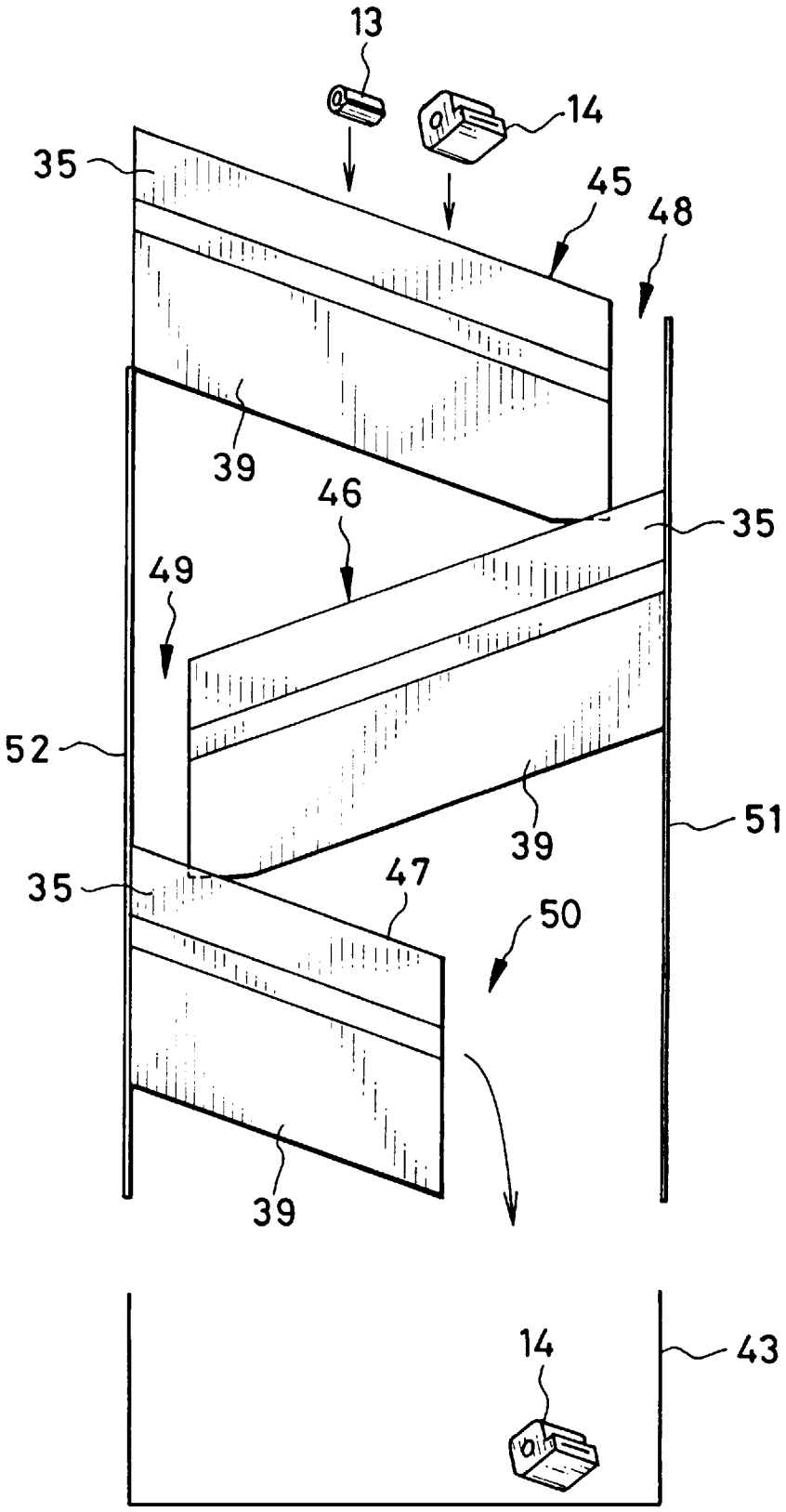
FIG. 6 is an explanatory side view of a film cartridge sorting device according to a second embodiment of the present invention.

In the above embodiment, the sifting chutes 31 to 33 have the dropping openings 42 and 42*a* at their lower ends. It is possible to replace the sifting chutes 31 to 33 with sifting chutes 45, 46 and 47 whose lower ends are shortened by the lengths of the dropping openings 42 and 42 respectively, as shown in FIG. 6. In this embodiment, the intermediate cartridge shells 14 drops off the sifting chutes 45 to 47 through gaps 48, 49 and 50 between their lower ends and stopping walls 51 or 52. In FIG. 6 and in the following embodiment, like or corresponding parts are designated by the same reference numbers as used in the first embodiment, so that the following description relates only to those features essential to the respective embodiments.

Figure 7:
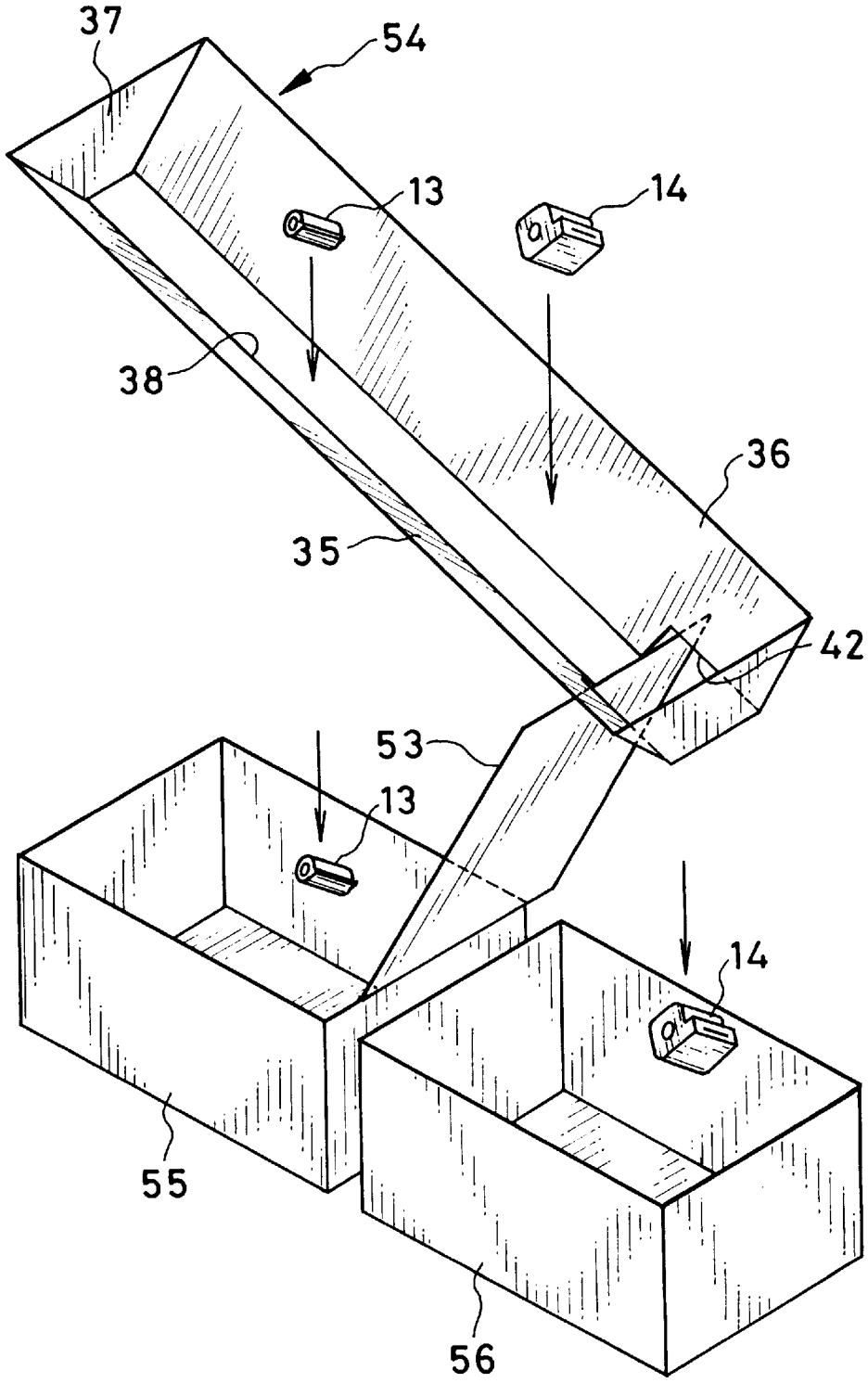
FIG. 7 is an explanatory perspective view of a film cartridge sorting device according to a third embodiment of the present invention.

The above embodiments use three sifting chutes 31 to 33 or 45 to 47, but the number of the sifting chutes may be less than three or more than three. When using a single sifting chute, it is possible to omit the lateral guide plate 39 and provide a partitioning plate 53 instead, as shown in FIG. 7. The partitioning plate 53 extends diagonally from the border between a sifting slit 38 and a dropping opening 42 down to a cartridge recovery box 55 for the ISO135 cartridge shells 13 that is placed under the sifting slit 38 of the sifting chute 54. According to the third embodiment of FIG. 7, a cartridge recovery box 56 for the intermediate cartridge shells 14 is placed under the dropping opening 42. The sliding surfaces of the sifting chutes 31 to 33, or 45 to 47, or 54 are preferably overlaid with rubber sheets or the like, for buffering the shock of drop.

Figure 8:
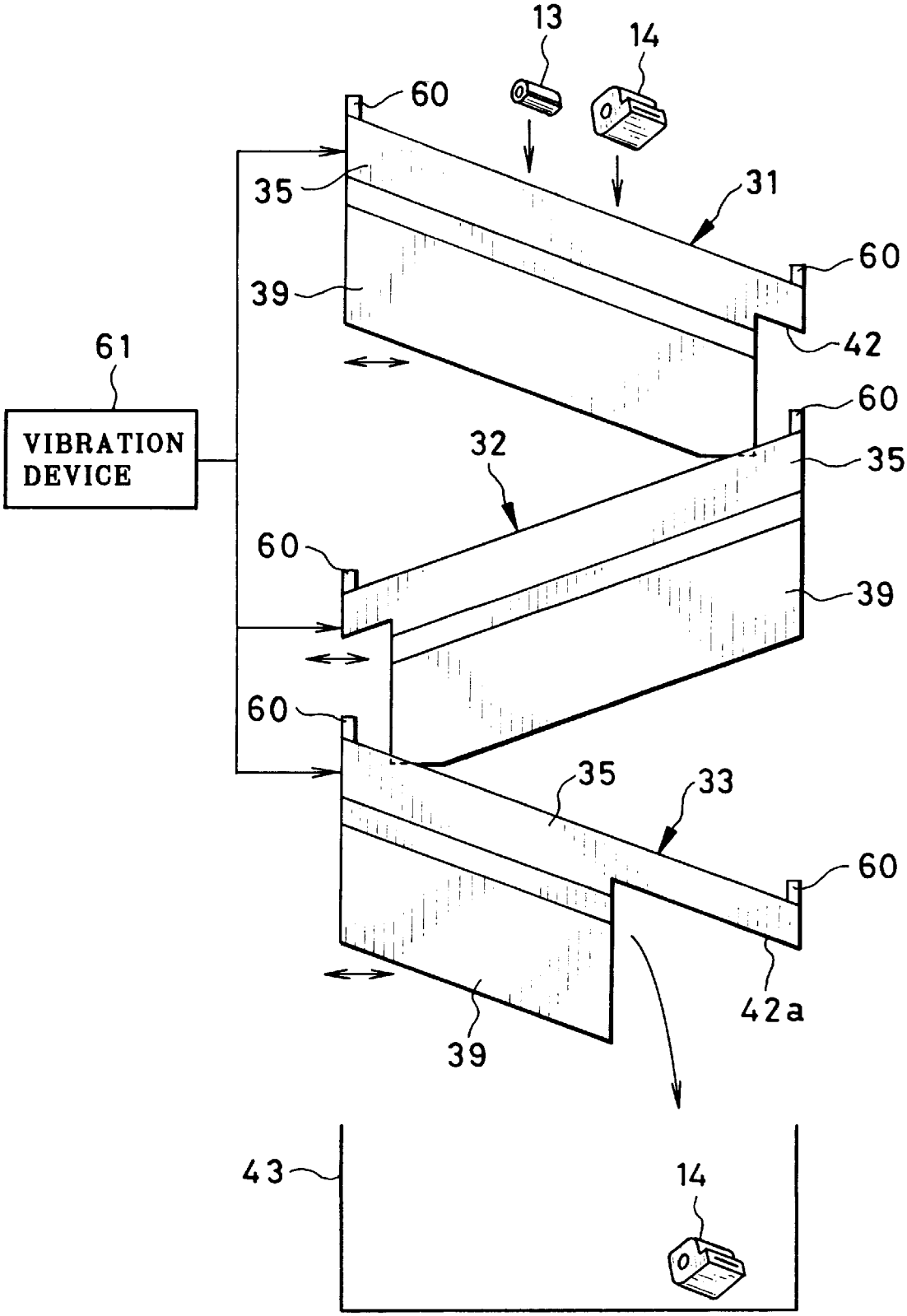
FIG. 8 is an explanatory side view of a film cartridge sorting device according to a fourth embodiment of the present invention.

For more effective sifting, it is preferable to vibrate the sifting chutes 31 to 33, or 45 to 47, or 54, as shown for example in FIG. 8. In that case, the sifting chutes 31 to 33 are supported by elastic supporting members 60 or by slidable members, and are vibrated by a vibration device 61. For example, the vibration device 61 is constituted of eccentric cams that are rotated by a motor, and vibrates the sifting chutes 31 to 33 in one or more than one of the longitudinal, lateral and vertical directions of the sifting chutes 31 to 33. It is possible to vibrate the sifting chutes 31 to 33 in different directions from each other. For example, vibrating the highest sifting chute 31 in the longitudinal direction, the middle sifting chute 32 in the lateral direction, and the lowest sifting chute 33 in the vertical direction will improve the efficiency of sorting the cartridge shells 13 and 14.

Figure 9:
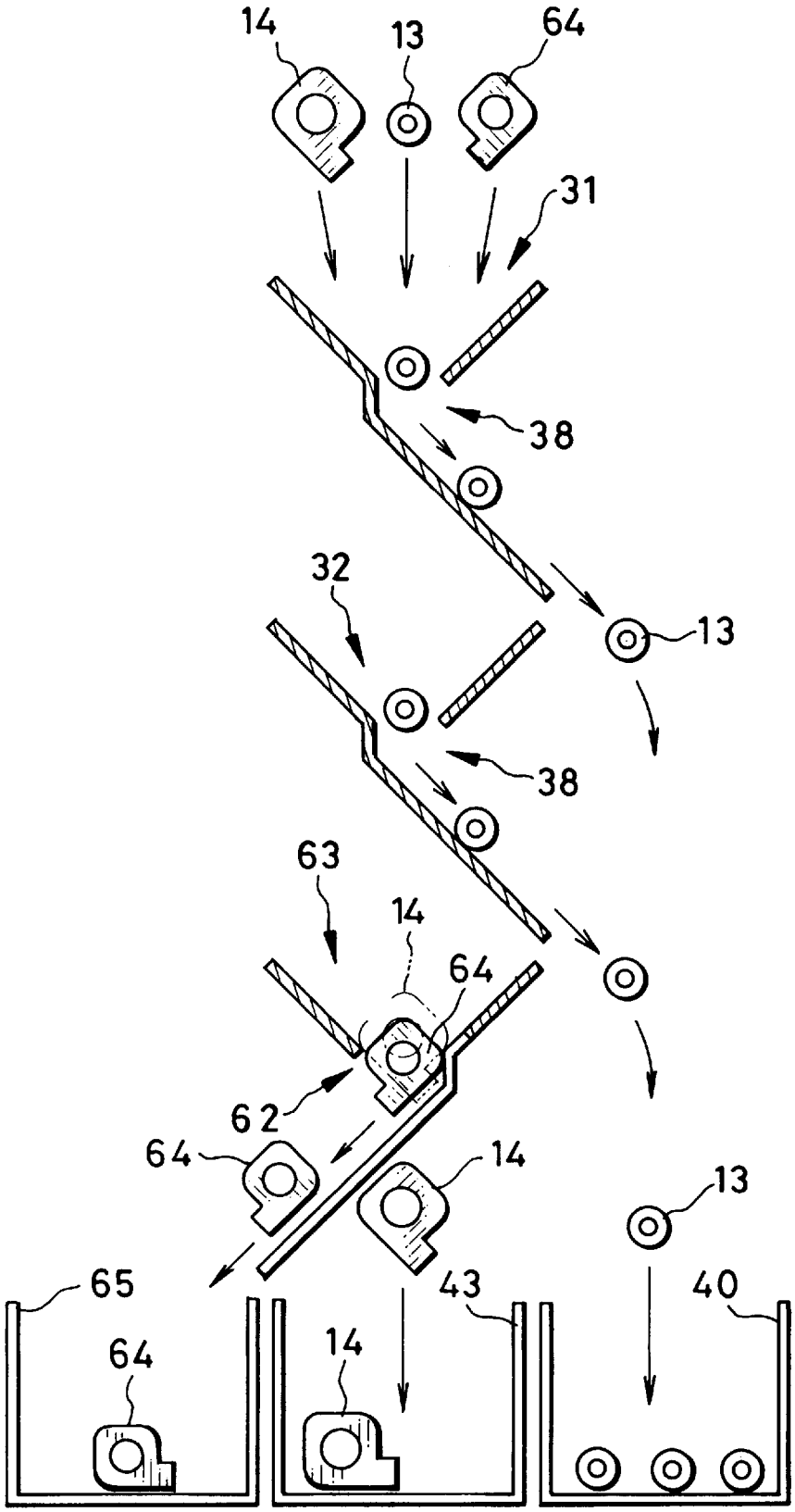
FIG. 9 is a sectional view of a film cartridge sorting device according to a fifth embodiment of the present invention.

It is also possible to provide sifting slits of different widths in the individual sifting chutes so as to sort cartridge shells into more than two types or sizes. According to an embodiment shown in FIG. 9, upper two sifting chutes 31 and 32 have sifting slits 38 of the same width for sifting the ISO135 type cartridge shells 13, whereas a third sifting chute 63 in the lowest position has a sifting slit 62 that is wider than the sifting slit 38 but not wider enough for the intermediate cartridge shells 14 of the IX240 type to drop therethrough. According to this configuration, those cartridge shells 64 which are smaller than the intermediate cartridge shells 14 but larger than the ISO135 type cartridge shells 13, e.g. intermediate cartridge shells 64 for the ISO110 type filmstrip, go through the sifting slit 62 and slide down to a third cartridge recovery box 65. The intermediate cartridge shells 14 and the ISO135 type cartridge shells 13 are discriminated in the same way as the first embodiment shown in FIGS. 3 to 5.

The film types are not limited to those mentioned in the above embodiments, but the cartridge sorting device 30 of the present invention can sort out cartridge shells of any types, if only their diameters or other dimensions are different, by designing sifting slits or dropping openings in correspondence with their dimensions. For instance, intermediate cartridge shells for the ISO120 type filmstrip have a larger diameter than those for the IX240 type, so sifting slits for the ISO120 type should be wider than sifting slit for the IX240 type. In any case, the lower sifting chute should have the wider sifting slit.

Figure 10:
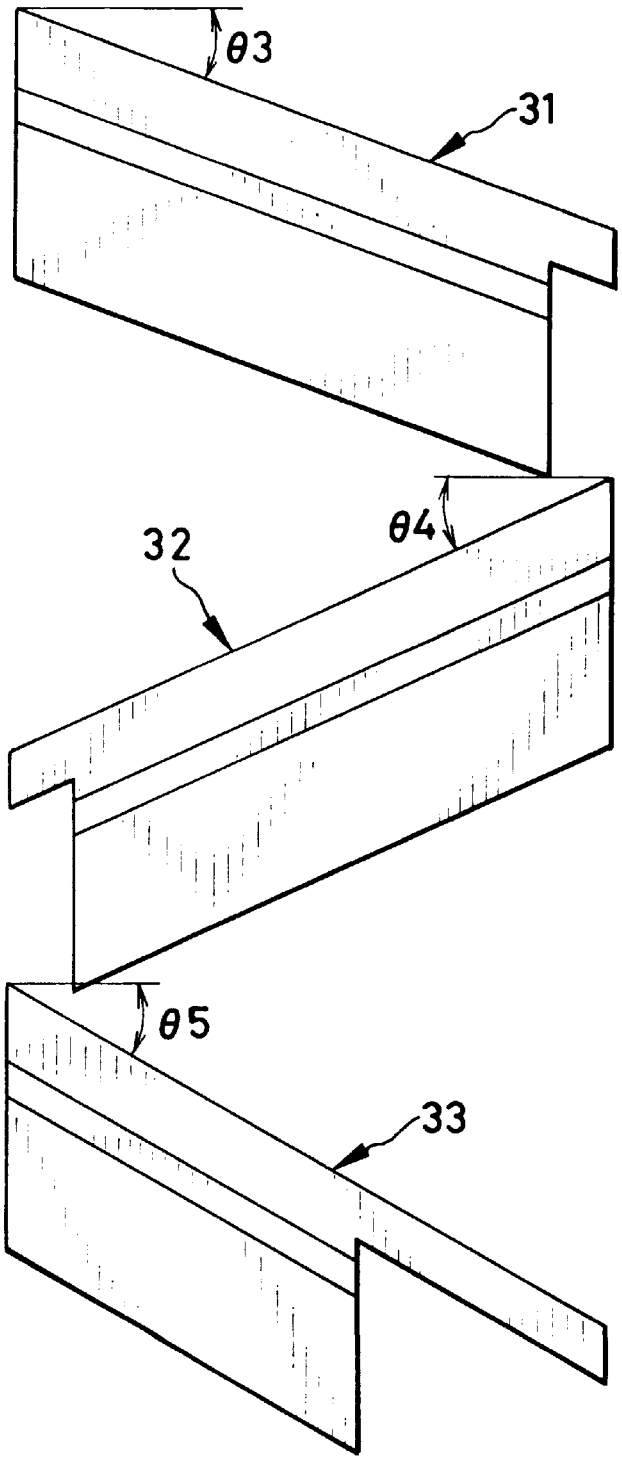
FIG. 10 is an explanatory side view of a film cartridge sorting device according to a sixth embodiment of the present invention.

In FIG. 3, the sifting chutes 31 to 33 have the same inclination angle $\Theta 1$. But the sifting chutes 31 to 33 may have different inclination angles $\Theta 3$, $\Theta 4$ and $\Theta 5$ from each other, as shown in FIG. 10, wherein $\Theta 3<\Theta 4<\Theta 5$. It is preferable to make the lower sifting chute have the larger inclination angle. This is because the sliding speed of the cartridge shells decreases as the cartridge shells slide down along the sifting chutes of the same inclination angle. By making the lower sifting chute steeper, the cartridge shells slide down at the same or increasing sliding speed, so that the cartridge shells would not stagnate on the lower sifting chutes.

Figure 11:
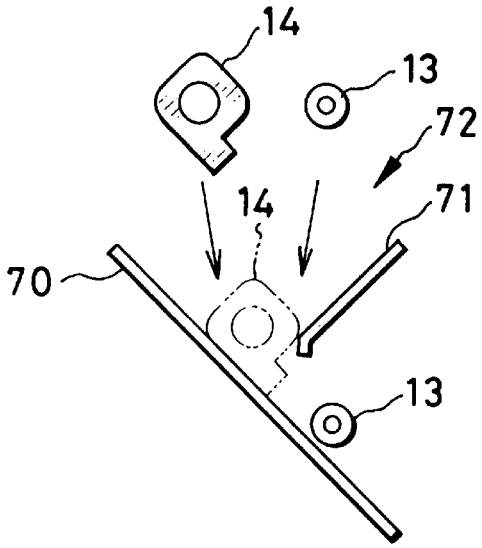
FIG. 11 is a sectional view of a sifting chute of a film cartridge sorting device according to another embodiment of the present invention.
Figure 12:
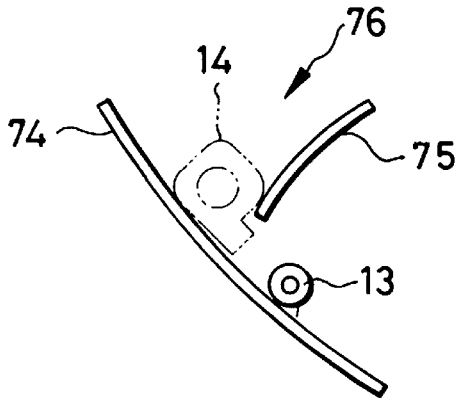
FIG. 12 is a sectional view of a sifting chute of a film cartridge sorting device according to a further embodiment of the present invention.
Figure 13:
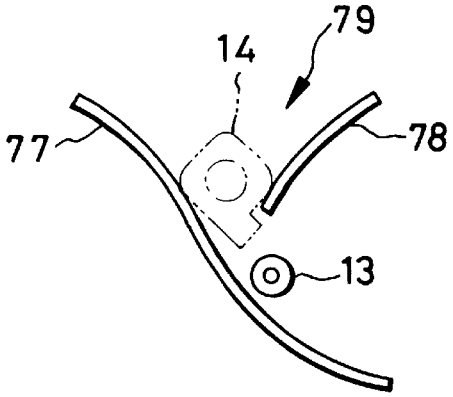
FIG. 13 is a sectional view of a sifting chute of a film cartridge sorting device according to still another embodiment of the present invention.

The shape of the sifting chute is not limited to the above embodiments. According to an embodiment shown in FIG. 11, a pair of guide plates 70 and 71 having different widths constitute a sifting chute 72. The wider guide plate 70 extends diagonally to an area under the narrower guide plate 71, so that the wider guide plate 70 doubles as a lateral guide plate for ejecting the ISO135 type cartridge shells 13 or another type of smaller cartridge shells from the sifting chute 72. Instead of the plane guide plates 70 and 71, curved guide plates 74 and 75 or 77 and 78 may be used for constituting a sifting chute 76 or 79, as shown in FIG. 12 or 13.

The cartridge sorting device 30 of the present invention may be a separate apparatus that is attachable to a film processor or is installed independently. In that case, a mixture of different types of cartridge shells collected in a recovery box from the film processor are thrown into the cartridge sorting device. Then the cartridge shells are automatically sorted through the cartridge sorting device.

As described so far, according to the present invention, cartridge shells of different types and sizes are sifted through the sifting slit while sliding along the sifting chute. Therefore, the cartridge sorting device of the present invention is simple in construction, and economical and ecological as it needs no electricity nor driving power. By providing the lateral guide plate, the cartridge shells having sifted through the sifting slit are guided in the lateral direction of the sifting chute, so that the sifted cartridge shells automatically drop in the cartridge recovery box that is placed on one side of the sifting chute. This configuration also makes it possible to arrange a plurality of sifting chutes vertically from one another, and connecting them in a zigzag fashion. Thereby, the cartridge sorting device is made compact while the total length of the sifting chutes is sufficient for reliable sorting.

The present invention is not to be limited to the above embodiments, but on the contrary, various modifications will be possible without departing from the scope of appended claims.

What is claimed is:

1. A cartridge sorting device, comprising:

a film cartridge chute which receives only film cartridges and which sorts according to the size of their cartridge shells; and a sifting slit formed through a bottom side of said film cartridge chute along the sliding direction of the film cartridges, said sifting slit letting smaller film cartridges than a predetermined size fall therethrough, while larger film cartridges than the predetermined size slide down to a lower end of said film cartridge chute.

2. A cartridge sorting device according to claim 1, wherein said chute comprises a pair of guide plates elongated in the sliding direction, said guide plates forming a substantially V-shaped sliding surface, said guide plates being spaced laterally from each other to form said sifting slit.

3. A cartridge sorting device according to claim 2, wherein a first member for receiving said smaller film cartridges is placed under said sifting slit, and a second member for receiving said larger film cartridges is placed under the lower end of said chute.

4. A cartridge sorting device according to claim 2, further comprising an opening formed through said chute at a lower end thereof, said opening being wider than said sifting slit so said larger film cartridges can drop therethrough.

5. A cartridge sorting device according to claim 2, further comprising a lateral guide plate extending under said sifting slit, for guiding said smaller cartridge shells having sifted through said sifting slit in the lateral direction of said chute.

6. A cartridge sorting device according to claim 5, wherein said lateral guide plate is formed integrally with one of said guide plates.

7. A cartridge sorting device according to claim 5, wherein a plurality of said chutes are arranged vertically from one another, the lower end of an upper one of said chutes being opposed to an upper end of a next one of said chutes to provide a zigzag sliding path.

8. A cartridge sorting device according to claim 7, wherein the sifting slit of a lower one of said chutes is wider than the sifting slit of the upper chutes, so as to sort the film cartridges into at least three sizes.

9. A cartridge sorting device according to claim 7, wherein a lower chute is steeper than the upper chute.

10. A cartridge sorting device according to claim 1, further comprising vibration means for vibrating said chute.

11. A cartridge sorting device according to claim 7, further comprising vibration means for vibrating said chutes in different directions.

12. A film processor for photographically processing exposed filmstrips, wherein the filmstrips are contained in their specific cartridge shells with their film leaders attached to a leader plate, and are fed into processing baths with the leader plate in the lead, the filmstrips being pulled out from the cartridge shells, the film processor comprising:

a film cartridge chute which receives only the cartridge shells, after being separated from the filmstrips;

a sifting slit formed through a bottom side of said film cartridge chute along a sliding direction of the film cartridges, said sifting slit letting smaller cartridge shells than a predetermined size sift therethrough, while larger cartridge shells than the predetermined size slide down to a lower end of said film cartridge chute:

a first cartridge recovery box placed below said film cartridge chute so as to receive said smaller cartridge shells having sifted through said sifting slit; and a second cartridge recovery box placed under the lower end of said film cartridge chute so as to receive said larger cartridge shells.

13. A film processor according to claim 12, wherein said chute comprises of a pair of guide plates elongated in the sliding direction, said guide plates forming a substantially V-shaped sliding surface, said guide plates being spaced laterally from each other to form said sifting slit.

14. A film processor according to claim 13, further comprising a lateral guide plate extending under said sifting slit, for guiding said smaller cartridge shells having sifted through said sifting slit in the lateral direction of said sifting chute toward said first cartridge recovery box.

15. A film processor according to claim 14, wherein a plurality of said chutes are arranged vertically from one another, the lower end of an upper one of said chutes being opposed to an upper end of a next one of said chutes to provide a zigzag sliding path.

* * * * *